United States Patent [19]

Rijnders

[11] Patent Number: 4,671,041

[45] Date of Patent: Jun. 9, 1987

[54] PANELLING SYSTEM AND CARRIER THEREFOR

[75] Inventor: Willem Rijnders, Papendrecht, Netherlands

[73] Assignee: Hunter Douglas International N.V., Curacao, Netherlands Antilles

[21] Appl. No.: 622,012

[22] Filed: Jun. 18, 1984

[30] Foreign Application Priority Data

Aug. 16, 1983 [GB] United Kingdom ..... 8321981

[51] Int. Cl.[4] ..... E04B 2/00

[52] U.S. Cl. ..... 52/762; 52/781

[58] Field of Search ..... 52/664–669, 52/483, 484, 542, 762, 780, 781, 478; 403/356, 357, 405

[56] References Cited

U.S. PATENT DOCUMENTS

| | | | |
|---|---|---|---|
| 3,184,017 | 5/1965 | Gravenor | 52/483 |
| 3,412,516 | 11/1968 | Linström | 52/762 |
| 3,678,641 | 7/1972 | Englund et al. | 52/781 |
| 4,134,244 | 1/1979 | Sjolander | 52/542 |
| 4,297,822 | 11/1981 | Rijnders | 52/484 |
| 4,328,653 | 5/1982 | Anderle | 52/762 |
| 4,441,297 | 4/1984 | Rijnders | 52/478 |

FOREIGN PATENT DOCUMENTS

| | | | |
|---|---|---|---|
| 1055795 | 4/1959 | Fed. Rep. of Germany | 52/483 |
| 2205479 | 8/1973 | Fed. Rep. of Germany | 52/542 |
| 2559077 | 7/1977 | Fed. Rep. of Germany | 52/664 |
| 1470366 | 2/1967 | France | 52/762 |
| 2026077 | 1/1980 | United Kingdom . | |
| 2052594 | 1/1981 | United Kingdom | 52/762 |

*Primary Examiner*—John E. Murtagh
*Assistant Examiner*—Andrew Joseph Rudy
*Attorney, Agent, or Firm*—Pennie & Edmonds

[57] ABSTRACT

A panelling system and carrier therefor for covering a wall or ceiling in which the panels have inturned side portions on each side, one of which is turned towards the other side and then back towards the main panel to provide a rim. The other side portion has at its free edge, an arm turned away from the one side. The panels are supported by inverted U- or V-shaped cross-section carriers formed with notches which define hook shaped lugs. These lugs are inserted into the rims of the panels and the arms of the adjacent panels overlie these rims. A space is provided above the thus mounted arms so that the arms can be lifted thereby to allow the underlying rim to be disengaged for the removal of a panel.

11 Claims, 4 Drawing Figures

PANELLING SYSTEM AND CARRIER THEREFOR

The present invention relates to a panelling system and to a carrier therefor.

One known form of panelling system includes panels each of which includes a main panel portion with a inturned side portion on each of each two opposite sides. One side portion has, at its free edge, a rim which is formed by being turned towards the other side portion and subsequently towards the main panel portion. The other side portion has, at its free edge, arm which is turned away from the one side portion.

Existing panelling systems have included carriers which support the panelling and these carriers take away different forms. They can include elongate carriers with clips attached thereto, as, for example, shown in British Pat. No. 2026077, or they can be formed by elongate members, for example, of inverted U or V-shaped, having notches formed therein which provide lugs which hold the panels in place. Such carriers normally require the panels themselves to be assembled in a sequential manner, starting at one end and finishing at the other end of the surface to be covered. Disassembly of the panelling system has to be effected in the reverse sequence which can be very inconveniant if access is desired to only a particular part of the panelling system, for example to have access to an electrical fitting or particular portion of pipework in a plumbing system.

For this reason, particularly for the application of panelling to a ceiling, the carriers have been provided with the certain amount of play in an upward direction towards the carrier, so as to enable dismounting of an intermediate panel. Apart from this, the conventional carriers are normally restricted to ceiling applications where the panels are kept in engagement by gravity, and the suspended panels may lift off inadvertently or may rattle under the action of wind. It has been proposed to insert additional spacers between the panel elements and the under sides of the carrier profiles to prevent this unintentional upward movement. Such a solution, however, is not fully satisfactory, as it is necessary to use additional labour and reduces the possibility of intermediate panel removal. It has also been proposed to provide for additional retainment of the panels in the longitudinal direction of the carriers, if the particular requirements have to be fulfilled in respect of resistance against deformation and loosening during fire. The known retaining means for that purpose could not ensure proper working and then did not allow removal of an intermediate panel.

It is now proposed, according to the present invention to provide a carrier for supporting panelling, the panels of which each have a main panel portion with an inturned side portion on each of two opposite sides, one side having, at its free edge, a rim which is turned towards the other side portion and subsequently towards the main panel portion, and the other side portion having, at its free edge, an arm which is turned away from the one side portion, said carrier comprising an elongate body securable to a support structure; at least one body portion carried by said elongate body; a plurarity of lugs on said body portion, the lugs being longitudinally spaced from one another, each lug being substantially rigid and including a hookshaped tongue spaced from a surface on the associated body portion surface to engage in the rim of one panel, a space adjacent said hook-shaped tongue and a locking portion arranged directly on said body portion on the opposite side of the space from said hook-shaped tongue said locking portion serving to hold the rim of one panel against the tongue of the relevant lug and to urge the arm of the adjacent panel against the rim of said one panel, said locking portion being positioned and dimensioned to operate with the arm of the adjacent panel, whereby, with one panel having its rim engaged on the hook-shaped tongue and the adjacent panel having its arm resting on the rim of said one panel and being held in position by said locking portion, the arm of said adjacent panel can be moved into a further part of said space, by pressure applied to said adjacent panel, to move the arm and part of said of other side portion along side the locking portion, to provide sufficient space for the rim of the one panel to be disengaged from the tongue and be removed from the carrier.

Such a carrier can be used for supporting panels disposed either vertically or horizontally that is on walls or ceilings and resists the accidental removel of the panels mounted on the carrier.

It is a further advantage of the construction of the present invention that the carrier in inexpensive to manufacture and easy to use in assembling or disassembling the panelling whether at the edges or at an intermediate location of the panelling. In fact the construction in such that the locking portions are so arranged that it is possible to remove a panel after a special sequence of operations involving also the panel adjacent to the panel concerned.

The locking portion is preferably rounded or chamfered adjacent to the further part of the space thus to facilitate the movement of the arm and part of the side portion along side the locking portion.

One particular construction according to the invention has the body portion in the form of a U or V Shaped cross-section elongate member having two legs forming the arms of the U or V, and the two legs are each provided with lugs, spaces and locking portions at the same axial location. Such a construction is particularly easy to manufacture and therefore inexpensive.

Advantageously, immediately above the locking portion, the legs of the U- or V-shaped carrier are each provided with openings for the insertion of a retaining member. This retaining member can ensure that the panel cannot accidently be removed, but yet they allow the panel to be removed deliberately.

The invention also provides a panelling system comprising panels which each have a main panel portion, an inturned side portion on each of two sides, one side portion having at its free edge a rim which is turned towards the other side portion and subsequently towards the main panel portion, and the other side portion having, at its free edge, an arm which is turned away from one side portion, a plurality of carriers each comprising an elongate body securable to a support structure, at least one body portion carried by said elongate body, a plurality of lugs on said body portion, the lugs being longitudianlly spaced from one another, each lug being substantially rigid and including a hook-shaped tongue spaced from a surface on the associated body portion and engaged in the rim of one panel a space being provided adjacent said hook-shaped tongue and a locking portion being arranged directly on said body portion on the opposite side of the space from said hook-shaped tongue, the locking portion holding the rim of one panel against the tongue of the relevant lug and the arm of the adjacent panel against the rim, said locking portion being positioned and dimensioned to co-operate with the arm of the adjacent panel whereby, with one panel having its rim engaged on the hook-shaped tongue and the adjacent panel having its arm resting on the rim of said one panel being held in position by said locking portion, the arm of said adjacent panel can be moved into a further part of said space to move the arm and part of said other side portion alongside the locking portion to provide sufficient space for the rim of the one panel to be disengaged from the tongue and for removal from the carrier.

According to a further aspect of the present invention there is provided a panelling system comprising panels which each have a main panel portion, an inturned side portion on each of two sides, one side portion having at its free edge a rim which is turned towards the other side portion, and the other side portion having, at its free edge, an arm which is turned away from the one side portion, a plurality of carriers each comprising an elongage body securable to a support structure, at least one body portion carried by said elongate body, a plurality of lugs on said body portion, the lugs being longitudinally spaced from one another, each lug being substantially rigid and including a tongue spaced from a surface on the associated body portion and engaged by the rim of said one panel, a space being provided adjacent to the tongue and a locking portion being arranged directly on said body portion on the opposite side of the space from said tongue, said locking portion holding the rim of one panel against the tongue of the relevant lug and the arm of the adjacent panel against the rim, openings formed in said at least one body portion adjacent to the locking portion and retaining members inserted in said openings to engage the said other side portion of a panel and thereby retain the panel in position.

In order that the present invention may more readily be understood, the following description is given, merely by way of example, reference being made to the accompanying drawing which:

Figure 1:
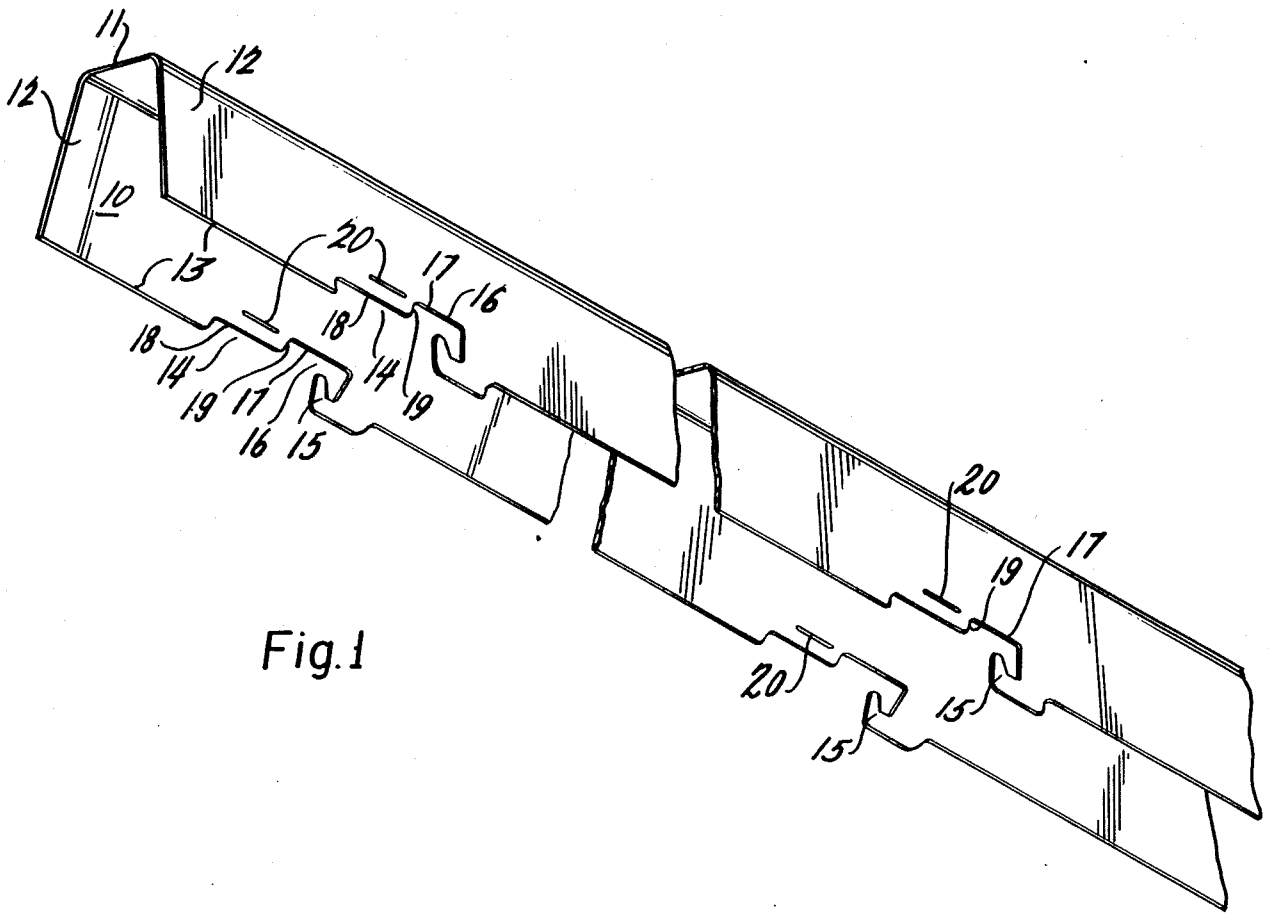
FIG. 1 is a schematic perspective view of embodiment of carrier according to the present invention.

Referring first to FIG. 1 the carrier 10 is of generally inverted U-shape having a web 11 and two legs 12.

At spaced intervals the legs 12 are provided, adjacent there lower edges 13, with notches 14 which define hook-shaped lugs 15 having a space 16 thereabove so that the lugs 15 are spaced from a surface 17 of the leg 12.

In each instance, to the left of the hook-shaped lug 15 is a locking portion 18 which ends, at its right end in a rounded or chamfered section 19.

Immediately above the locking portion 18 is a slot shaped opening 20.

Figure 2:
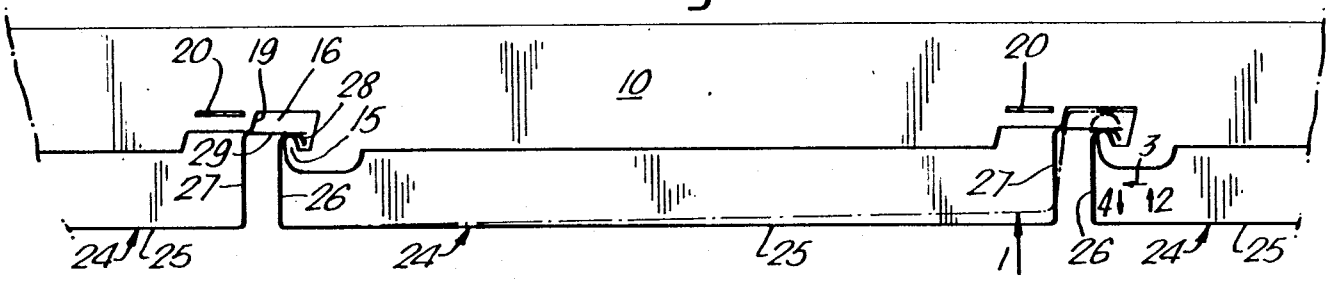
FIG. 2 is a side elevation of a portion of the carrier of FIG. 1 shown with three panels mounted thereon.

As seen in FIG. 2, three panels 24 are mounted on the carrier 10. Each panel consists of a main panel portion 25 having a inturned side portion 26 on its left side and the second inturned side portion 27 on its right side. The first inturned portion 26 is formed with a rim 28 at its free edge which is turned towards the other side portion 27 of that panel and then towards the main panel portion 25 of that panel. The side portion 27 is provided with an arm 29 which is turned away from the one side portion 26 of that panel.

As can be seen in the drawing an arm 29 of one panel is inserted into the space 16 so that it passes above the hook-shaped lug 15 and the panel is then pivoted so that its rim 28 extends into the notch 14 at the location at the next pair of lugs 15. The rim 28 is urged upwardly and then moved to the right, so that it hooks over the hook-shaped lug 15 to hold the panel in place. The next panel to the left is then positioned in the same way and so one. In this condition, the left hand end of each arm 29 abuts against the lower surface of the locking portion 18 thus to retain the arm and the rim of the adjacent panel in position. Thus the hook-shaped lug engaged in the rim prevents the panel from moving laterally accidently.

When it is desired to remove a panel, whether it be a side panel or an intermediate panel, one presses upwardly as indicated by the arrow 1 in FIG. 2 and the panel takes up the position indicated in dotted lines. The provision of the rounded or chamfered part of the locking portion enables the side portion 27, and its associated arm 29 to move upwardly into space 16. And thereafter one carries out the upward movement indicated by the arrow 2 of the left side of the panel 24, which is then moved slightly to the left as indicated by the arrow 3 and then lowered as indicated by the arrow 4. In this way the rim 28 is disengaged from the hook-shaped lug 15.

Figure 3:
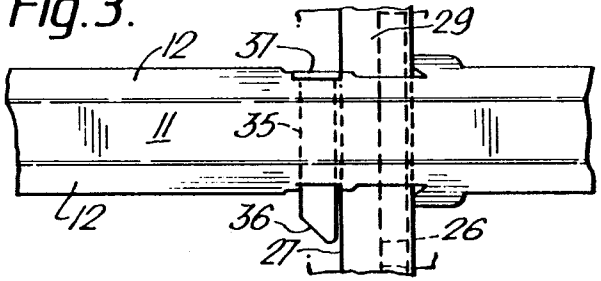
FIG. 3 is a fragmentary top plan view showing the insertion of the further retaining means.
Figure 4:
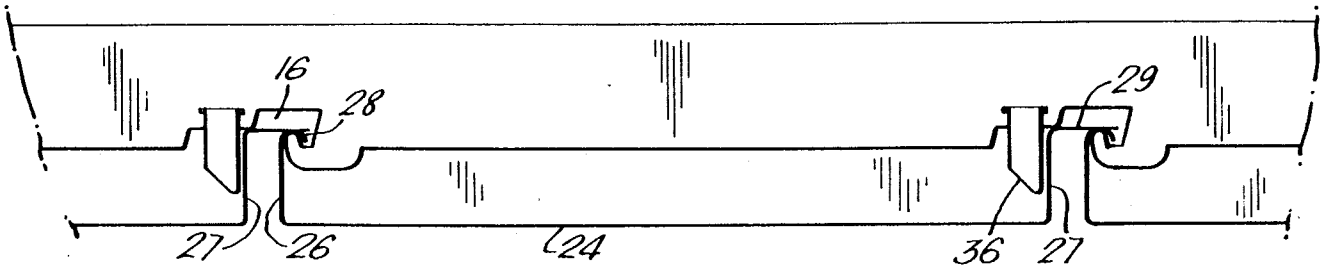
FIG. 4 is a side elevation, similar to FIG. 2, but showing the retaining means in the final position.

The purpose of the opening 20 is to enable a retaining member in the form of a T-section strip to be inserted after to the panels are in position. As indicated in FIG. 3 the retaining member 35 is a generally T shaped cross section and has a sharpened end 36 and a head 37. With the panel in position one pushes this strip through the two openings 20 associated with the edge of a pair of panels. This is indicated clearly in FIG. 3. With the strip 35 in this position one bends the end downwardly to the position illustrated in FIG. 4. It will be seen at the end 36 is then engaged to the left of the side portion 27 of a panel so that the panel cannot be readily be removed. This is particularly important in a fire situation in which the panels are subjected to heat and therefore to a buckling action. The provision of the retaining means 35 prevents the panels from falling down and therefore enables the panelling system to meet fire regulations.

It will be appreciated that the structure of the present invention is very simple and yet is effective.

I claim:

1. A carrier for supporting panelling, the panels of which each have a main panel portion with an inturned side portion on each of two opposite sides, one side portion having, at its free edge, a rim which is turned towards the other side portion and subsequently towards the main panel portion, and the other side portion having, at its free edge, an arm which is turned away from the one side portion, said carrier comprising an elongate body securable to a support structure; at least one downwardly extending body portion having a lower longitudinally extending edge carried by said elongate body; a plurality of longitudinally extending notches in said lower edge of said body portion, the notches being longitudinally spaced from one another, and having opposite longitudinally spaced ends and a top surface; a lug at one end of each notch, each lug being substantially rigid and including a hook-shaped tongue spaced from said top surface of the notch to define a space above the lug, each hook-shaped tongue facing in the same direction longitudinally along said body portion for engaging in the rim of one panel with the arm of the adjacent panel overlying said rim and with the main panel portion of both panels spaced below the lower edge of the body portion of said carrier; and a locking portion arranged directly on said body portion at the other end of said notch, said locking portion facing downwardly at a location below the top surface of said notch and spaced vertically above said tongue for engaging against the arm of the adjacent panel to hold said arm against the rim of said one panel and the rim of the one panel against the tongue of said lug, said locking portion being positioned and dimensioned to operate with the arm of the adjacent panel, whereby, with the one panel having its rim engaged on the hookshaped tongue and the adjacent panel having its arm resting on the rim of said one panel and being held in position by said locking portion, the arm of said adjacent panel can be moved longitudinally along the body portion of said carrier toward the one end of said notch and vertically past said locking portion and into said space by pressure applied to said adjacent panel to move the arm and part of said other side portion upwardly alongside the locking portion and provide sufficient vertical space for the rim of the one panel to be moved upwardly and disengaged from the tongue and removed from the carrier.

2. The carrier according to claim 1, wherein each locking portion is rounded or chamfered adjacent said further part of said space, to facilitate the movement of the arm and part of said side portion alongside the locking portion.

3. A carrier according to claim 1 or 2, wherein the body portion is in the form of a U- or V-shaped cross section elongate member having two legs forming the arms of the U or V, and wherein the two legs are each provided with lugs, spaces and locking portions at the same axial location.

4. A carrier for supporting panelling, the panels of which each have a main panel portion with an inturned side portion on each of two opposite sides, one side portion having, at its free edge, a rim which is turned towards the other side portion and subsequently towards the main panel portion, and the other side portion having, at its free edge, an arm which is turned away from the one side portion, said carrier comprising an elongate body securable to a support structure; at least one body portion carried by said elongate body; a plurality of lugs on said body portion, the lugs being longitudinally spaced from one another, each lug being substantially rigid and including a hook-shaped tongue spaced from a surface on the body portion surface to engage in the rim of one panel, a space adjacent said hook-shaped tongue and a locking portion arranged directly on said body portion on a side of the space opposite from said hook-shaped tongue, said locking portion serving to hold the rim of one panel against the tongue of the relevant lug and to hold the arm of the adjacent panel against the rim of said one panel, said locking portion being positioned and dimensioned to operate with the arm of the adjacent panel, whereby, with one panel having its rim engaged on the hook-shaped tongue and the adjacent panel having its arm resting on the rim of said one panel and being held in position by said locking portion, the arm of said adjacent panel can be moved into a further part of said space, by pressure applied to said adjacent panel, to move the arm and part of said of other side portion alongside the locking portion, to provide sufficient space for the rim of the one panel to be disengaged from the tongue and be removed from the carrier, wherein the body portion is in the form of a U- or V-shaped cross section elongate member having two legs forming the arms of the U or V, and wherein the two legs are each provided with lugs, spaces and locking portions at the same axial location, wherein immediately above the locking portions the legs of the U- or V-shaped carrier are each provided with openings for the insertion of a retaining member, said retaining member being positioned to prevent movement in one direction of said adjacent panel away from said one panel.

5. A carrier according to claim 4, wherein the retaining member is in the form of a T-section strip which can be passed through the openings in each of the legs of the carrier and extend therebeyond, with the cross part of the T engaging one leg and with a tab at the end portion of the strip being capable of being bent out of its plane.

6. A panelling system comprising panels which each have a main panel portion, an inturned side portion on each of two opposite sides, one side portion having at its free edge a rim which is turned towards the other side portion and subsequently towards the main panel portion, and the other side portion having, at its free edge, an arm which is turned away from the one side portion, a plurality of carriers each comprising an elongate body securable to a support structure; at least one downwardly extending body portion having a lower longitudinally extending edge carried by said elongate body; a plurality of longitudinally extending notches in said lower edge of said body portion, the notches being longitudinally spaced from one another, and having opposite longitudinally spaced ends and a top surface; a lug at one end of each notch, each lug being substantially rigid and including a tongue spaced from said top surface of the notch to define a space above the lug, each tongue facing in the same direction longitudinally along said body portion for engaging in the rim of one panel with the arm of the adjacent panel overlying said rim and with the main panel portion of both panels spaced below the lower edge of the body portion of said carrier; and a locking portion arranged directly on said body portion at the other end of said notch, said locking portion facing downwardly at a location below the top surface of said notch and spaced vertically above said tongue for engaging against the arm of the adjacent panel to hold said arm against the rim of said one panel and the rim of the one panel against the tongue of said lug, said locking portion being positioned and dimensioned to operate with the arm of the adjacent panel, whereby, with the one panel having its rim engaged on the tongue and the adjacent panel having its arm resting on the rim of said one panel and being held in position by said locking portion, the arm of said adjacent panel can be moved longitudinally along the body portion of said carrier toward the one end of said notch and vertically past said locking portion and into said space by pressure applied to said adjacent panel to move the arm and part of said other side portion upwardly alongside the locking portion and provide sufficient vertical space for the rim of the one panel to be moved upwardly and disengaged from the tongue and removed from the carrier.

7. A panelling system according to claim 6 wherein each carrier is in the form of is U- or V-shaped cross section elongate member having two legs forming the arms of the U or V, and wherein the two legs are each provided with lugs, spaces and locking portions at the same axial location.

8. A panelling system comprising panels which each have a main panel portion, an inturned side portion on each of two opposite sides, one side portion having at its free edge a rim which is turned towards the other side portion and subsequently towards the main panel portion, and the other side portion having, at its free edge, an arm which is turned away from the one side portion, a plurality of carriers each comprising an elongate body securable to a support structure and having a U- or V-shaped elongate member with two leges forming the arms of the U or V, a plurality of lugs at the same axial position on each of said legs, the lugs being longitudinally spaced from one another, each lug being substantially rigid and including a hook-shaped tongue spaced from a surface on the arms and engaged in the rim of one panel, a space being provided on each of said legs adjacent said hook-shaped tongue and a locking portion being arranged directly on each of said legs on a side of the space opposite from said hook-shaped tongue, the locking portion holding the rim of one panel against the tongue of at least one lug and the arm of the adjacent panel against the rim, said locking portion being positioned and dimensioned to cooperate with the arm of the adjacent panel whereby, with one panel having its rim engaged on the hook-shaped tongue and the adjacent panel having its arm resting on the rim of said one panel being held in position by said locking portion, the arm of said adjacent panel can be moved into a further part of said space to move the arm and part of said other side portion alongside the locking portion to provide sufficient space for the rim of the one panel to be disengaged from the tongue and for removal from the carrier; and openings located immediately above the locking portions of the legs of the U-or V-shaped carriers for the insertion of a retaining member.

9. A panelling system comprising panels which each have a main panel portion, an inturned side portion on each of two opposite sides, one side portion having at its free edge a rim which is turned towards the other side portion, and the other side portion having, at its free edge, an arm which is turned away from the one side portion, a plurality of carriers each comprising an elongate body securable to a support structure, at least one body portion carried by said elongate body, a plurality of lugs on said body portion, the lugs being longitudinally spaced from one another, each lug being substantially rigid and including a tongue spaced from a surface on the body portion and engaged by the rim of said one panel, a space being provided adjacent to the tongue and a locking portion being arranged directly on said portion on a side of the space opposite from said tongue, said locking portion holding the rim of one panel against the tongue of the relevant lug and the arm of the adjacent panel against the rim, openings formed in said at least one body portion adjacent to the locking portion and retaining members inserted in said openings to engage the said other side portion of a panel and thereby retain the panel in position.

10. A panelling system comprising panels which each have a main panel portion, an inturned side portion on each of two opposite sides, one side portion having at its free edge a rim which is turned towards the other side portion, and the other side portion having, at its free edge, an arm which is turned away from the one side portion, a plurality of carriers each comprising an elongate body securable to a support structure, at least one body portion carried by said elongate body, a plurality of lugs on said body portion, the lugs being longitudinally spaced from one another, each lug being substantially rigid and including a tongue spaced from a surface on the body portion and engaged by the rim of said one panel, a space being provided adjacent to the tongue and a locking portion being arranged directly on said portion on a side of the space opposite from said tongue, said locking portion holding the rim of one panel against the tongue of the relevant lug and the arm of the adajacent adjacent panel against the rim, openings formed in said at least one body portion adjacent to the locking portion and retaining members inserted in said openings to engage the said other side portion of a panel and thereby retain the panel in position wherein each carrier is in the form of a U- or V-shaped cross-section elongate member having two legs forming the arms of the U or V, the two legs each being provided with lugs, spaces and locking portions at the same axial location and the opening being immediately above the locking portions in the legs of the U or V-shaped carriers for the insertion of said retaining members.

11. A panelling system according to claim 10 or 8 wherein the retaining members are each in the form of a T-section strip which can be passed through the openings in each of the legs of the carrier and extend therebeyond, with the cross part of the T engaging one leg and with a tab at the end portion of the strip being capable of being bent our of its plane.

* * * * *